US006197175B1

(12) United States Patent
Kisi et al.

(10) Patent No.: US 6,197,175 B1
(45) Date of Patent: Mar. 6, 2001

(54) ELECTRICAL CONTACTING SYSTEM FOR AN ELECTROPHORETIC DIP PAINTING PLANT FOR MOTOR VEHICLE BODIES

(75) Inventors: Hidayet Kisi, Heilbronn; Heiko Haefecker, Langwedel; Reinhard Miesner, Zeven; Thomas Mayer, Bremerhaven; Karl-Heinz Zenker, Morsum, all of (DE)

(73) Assignees: Durr Systems GmbH; DaimlerChrysler AG, both of Stuttgart (DE)

( * ) Notice: Subject to any disclaimer, the term of this patent is extended or adjusted under 35 U.S.C. 154(b) by 0 days.

(21) Appl. No.: 09/386,106

(22) Filed: Aug. 30, 1999

(30) Foreign Application Priority Data

Sep. 1, 1998 (DE) ..... 198 39 725

(51) Int. Cl.[7] ..... C25D 13/00; C25D 17/00

(52) U.S. Cl. ..... 204/623; 204/198

(58) Field of Search ..... 204/198, 623

(56) References Cited

U.S. PATENT DOCUMENTS

| | | | | |
|---|---|---|---|---|
| 4,663,014 | * | 5/1987 | Bassett et al. | 204/198 |
| 4,668,358 | * | 5/1987 | Ball | 204/623 |
| 4,740,284 | * | 4/1988 | Bolte et al. | 204/198 |
| 4,752,172 | * | 6/1988 | Bolte | 204/198 |
| 4,904,365 | * | 2/1990 | Kawamura et al . | 204/623 |

FOREIGN PATENT DOCUMENTS 40 41 211 C1 1/1992 (DE) .

* cited by examiner

*Primary Examiner*—Kathryn Gorgos
*Assistant Examiner*—Thao Tran
(74) *Attorney, Agent, or Firm*—Barry R. Lipsitz

(57) ABSTRACT

Electrical contacting system for an electrophoretic dip painting plant for motor vehicle bodies, where the bodies are guided through an electrophoretic dip paint bath by an overhead conveyor having hangers for engaging beneath the body carriers. Each conveyor hanger has at least two lower contacting devices secured thereto and each body carrier has at least four upper contacting devices secured thereto. Each upper contacting device has a protective bell open at the bottom and storing an air bubble in the submerged state. In the area of the air bubble the bell has a downwardly concave, partially circular cylindrical support and contact surface and has a horizontal cylinder axis extending transversely to the conveyance direction. At its outer side facing the guide element, two locking elements form a vertical opening therebetween to interact with a locking nose on the guide element where the locking noses pass through the openings formed by the locking elements. To ensure a secure locking of the protective bell on the lower contacting device, a system is designed where the protective bell is provided with the locking elements having a rigid axle stub coaxial to the cylinder axis of its support and contact surface. The guide element has an upwardly open guide slot parallel to the support and contact element of the lower contacting device. The side edges of this slot forming insertion curves for the axle stub which extend at an angle towards one another from top to bottom.

12 Claims, 4 Drawing Sheets

ELECTRICAL CONTACTING SYSTEM FOR AN ELECTROPHORETIC DIP PAINTING PLANT FOR MOTOR VEHICLE BODIES

BACKGROUND OF THE INVENTION

The invention relates to an electrical contacting system for an electrophoretic dip painting plant for motor vehicle bodies, with which the bodies are guided through an electrophoretic dip paint bath by means of an overhead conveyor. The bodies are thereby each arranged on a body carrier and connected to this in an adequately secure manner; the body carrier is a flat structure which is approximately rectangular in the plan view, is customarily designated as a slide or skid and often has the shape of a rectangular carrier frame. The overhead conveyor possesses a plurality of conveyor hangers which are arranged one behind the other in the direction of conveyance and in spaced relation to one another and which are suspended so as to be pivotable about upper pivot axes extending horizontally and transversely to the direction of conveyance and are designed such that two conveyor hangers following one another in the direction of conveyance can engage beneath a respective body carrier in its front and in its rear area, respectively, and support it; normally, the conveyor hangers have the shape of a rectangular frame with a lower crossbar for engaging beneath a body carrier, wherein the plane of the frame normally extends vertically.

In the case of the electrophoretic dip paint bath, this is an aqueous suspension, from which color particles are deposited on the body submerged in the paint bath by way of electrophoresis when a corresponding, electrical difference in potential is maintained between the paint bath and the body. For this purpose, the bodies are connected in an electrically conductive manner to the metal body carriers and a corresponding electrical potential is applied to the conveyor hangers via the overhead conveyor; in addition, not only the conveyor hangers but also the body carriers are provided with electrical contacting devices which provide an electrical connection between conveyor hanger and body carrier when the latter is placed on two conveyor hangers. Moreover, these contacting devices also have the task of preventing any floating up of a body and thus any lifting of the body carrier from the two conveyor hangers supporting it when the overhead conveyor submerges the body in the paint bath—even if the body of a passenger vehicle is submerged in the paint bath with an open trunk lid, the trunk may, in the case of certain body shapes, not be filled by the aqueous suspension forming the paint bath until the load sill of the trunk dips into the paint bath and so without any locking of the body carrier to the conveyor hangers the trunk still filled with air would lead to the body carrier lifting away, in particular, from the conveyor hanger adjacent to the trunk.

DE-40 41 211-C1 discloses an electrophoretic dip painting plant of the type described above. In the known construction, the conveyor hangers have the shape of rectangular frames with a plane of the frame normally extending vertically and the body carriers have the shape of rectangular frames with a plane of the frames extending horizontally over the greatest portion of the path of conveyance. Two lower contacting devices are secured to the lower crossbar of each conveyor hanger and these consist essentially of a support and contact pin projecting vertically upwards and a rail-like guide element arranged next to the pin transversely to the direction of conveyance and likewise projecting vertically upwards. Two upper contacting devices are secured to each of the two longitudinal frame legs of the body carrier, namely one in the front and one in the rear area of the body carrier; each of these contacting devices has a metal protective bell which is open to the bottom, may be placed from above onto the support and contact pin of one of the lower contacting devices and encloses and stores a bubble of air when it dips into the paint bath from above. The protective bell has two side walls and a circular cylindrical circumferential wall which connects these side walls to one another and forms with the inner side of its upper area a support and contact surface, against which the associated support and contact pin abuts when the body carrier is borne by two conveyor hangers. The bubble of air ensures a good electrical contact between the contact surface of the protective bell and the upper end of the support and contact pin—color is applied not only to the body but also to all the areas of the body carrier coming into contact with the paint bath and the upper contacting devices secured to it. Two rib-like locking elements projecting from the side wall of the protective bell facing the guide element of the associated, lower contacting device are secured to this side wall and these locking elements—in a view of this side wall—extend downwards at an angle and towards one another, wherein their lower ends are arranged at a transverse distance from one another so that they form an opening between them, and wherein the angle bisector of the angle formed by the two locking elements extends through the cylinder axis of the circumferential wall of the protective bell.

These two locking elements interact with a locking nose, which is secured to the guide element of the lower contacting device, is approximately of a saw tooth shape in the side view and may be pushed through between the two locking elements from below with a horizontally extending body carrier and vertically extending conveyor hanger, but prevent any lifting of the protective bell from the lower contacting device as soon as—when seen transversely to the direction of conveyance and horizontally—the angle formed by the plane of the frame of the conveyor hanger and the plane of the frame of the body carrier deviates from 90° by more than a specific angle. Since—as is apparent from FIG. 1 of DE-40 41 211-C1—the overhead conveyor submerges the body carriers in the paint bath at an angle and also guides them out of the paint bath again at an angle, wherein the plane of the frame of the guide hangers still extends at least approximately vertically even in this case, such angular deviations occur not only during the submergence of the bodies into the paint bath but also during the guidance of the bodies out of the paint bath.

It has been shown in practice that the construction resulting from DE-40 41 211-C1 cannot ensure a reliable locking of the body carrier on the conveyor hangers, namely during the submergence of the bodies into the paint bath: In this respect, the conveyor hanger adjacent to the trunk of the body and the body carrier can be pivoted relative to one another such that the angle bisector of the V-shaped configuration formed by the two locking elements of a protective bell forms with the plane of the frame of the conveyor hanger a relatively small, acute angle of up to, for example, approximately 12°. This can result in the protective bell disengaging at the lower contacting device when the protective bell moves relative to the support and contact pin of the lower contacting device, during the course of the relative movement between body carrier and conveyor hanger, such that the contact pin does not constantly extend in a plane of diameter of the circular cylindrical circumferential wall of the protective bell. Such a disengaging of protective bells of the body carriers at the lower contacting devices of the conveyor hangers can, however, have extremely disadvantageous consequences—once the bodies are completely submerged in the paint bath, the body carriers are again lowered onto the conveyor hangers, and in this respect protective bells which have previously become disengaged can come to rest adjacent to the associated support and contact pins.

SUMMARY OF THE INVENTION

The object underlying the invention was, therefore, to improve electrical contacting systems of the type such as those resulting from DE-40 41 211-C1 such that the malfunctioning described in the above cannot occur.

To accomplish the set object, the invention proceeds on the basis of an electrical contacting system for an electrophoretic dip painting plant for motor vehicle bodies, with which the bodies are guided through an electrophoretic dip paint bath by means of an overhead conveyor which has conveyor hangers for engaging beneath body carriers each supporting one body and being placeable on two respective conveyor hangers, these hangers being arranged one behind the other in the direction of conveyance and being pivotable about upper pivot axes extending horizontally and transversely to the direction of conveyance, wherein the contacting system has for each conveyor hanger at least two lower contacting devices secured thereto as well as for each body carrier at least four upper contacting devices secured thereto and adapted to be placed on the lower contacting devices, each lower contacting device has a support and contact element pointing upwards as well as a guide element arranged next to this element transversely to the direction of conveyance and likewise pointing upwards and each upper contacting device has a protective bell open at the bottom and storing a bubble of air in the submerged state, the protective bell having in the area of the bubble of air a downwardly concave, partially circular cylindrical support and contact surface adapted to be placed on a support and contact element and having an approximately horizontal cylinder axis extending transversely to the direction of conveyance as well as on its outer side facing the guide element two locking elements forming a vertical opening between them for interacting with a locking nose on the guide element in order to make passage of the locking noses through the openings formed by the locking elements of the protective bells possible during placement of a body carrier on two conveyor hangers and to prevent any lifting of the protective bells away from the lower contacting devices during the inclined submergence of a body into the paint bath.

In accordance with the invention, such a contacting system is designed such that the protective bell has at its outer side provided with the locking elements a rigid axle stub coaxial to the cylinder axis of its support and contact surface and the guide element has for a lateral guidance of the axle stub an upwardly open guide slot which is parallel to the support and contact element of the lower contacting device and the side edges of which form in the upper area of the guide slot insertion curves for the axle stub which extend at an incline from top to bottom towards one another.

When in the above and in the following a vertical opening between the locking elements of a protective bell is mentioned, it goes without saying that this opening is, of course, vertically aligned only when the body carrier is in the horizontal but not after any pivoting of the body carrier.

As for the rest, reference is made to DE-40 41 211-C1 with respect to the operation of the electrophoretic dip painting plant as well as the design and functioning of the contacting system and the content of this publication is also intended to be made the subject matter of the present application.

The inventive contacting system results in the following, advantageous functioning:

Due to the fact that the axle stub of the protective bell cannot deflect to the side, i.e. in the direction of conveyance or contrary to the direction of conveyance, as a result of its engagement in the guide slot of the guide element of the lower contacting device and, consequently, it is ensured that the axis of the axle stub always intersects the longitudinal axis of the support and contact element of the lower contacting device, it is also ensured that the support and contact element which is preferably pin-like is always located in a plane of diameter of the circular cylindrical support and contact surface of the protective bell or rather always abuts against the respectively highest location of the support and contact surface when protective bell and lower contacting device are pivoted relative to one another; consequently, the two locking elements arranged on the protective bell and, with them, the opening formed by them and the locking nose arranged on the lower contacting device may only be pivoted relative to one another but not displaced laterally in relation to one another and so with a corresponding dimensioning and arrangement of the opening and the locking nose the protective bell is already locked on the lower contacting device even with relatively small pivot angles. It is thus the basic principle of the invention to fix the rotational or rather pivot axis of the protective bell in relation to the lower contacting device not in longitudinal direction of the guide slot of the contacting device but transversely to this longitudinal direction so that even a body still partially filled with air cannot lead to any disengaging of the protective bell at the lower contacting device when the body is submerged into the paint bath along a path extending at an angle. The insertion curves for the axle stub provided in the upper end region of the guide slot represent an additional, advantageous feature which ensures that the axle stub is lowered into the guide slot when a body carrier is placed on two conveyor hangers, even if its width in its area serving for the transverse or rather lateral guidance of the axle stub is only insignificantly larger than the diameter of the axle stub—without these insertion curves careful attention would have to be paid during the placement of a body carrier on the conveyor hangers that body carrier and conveyor hanger are positioned exactly relative to one another.

It should also be emphasized that it is not critical when, for example, the support and contact elements adjacent to a trunk still filled with air lift away form the support and contact surfaces of the protective bells associated with these contact elements when the body is submerged into the paint bath along a path extending at an angle since the electrical connection between overhead conveyor and body is always still ensured by the other protective bells and lower contacting devices—it is only important for the protective bells adjacent to the area of the body still filled with air to remain locked on the lower contacting devices associated with them and not be able to disengage from them.

The inventive contacting system preferably has one or several features of the known contacting system resulting from DE-40 41 211 C1. As already mentioned, the support and contact elements of the lower contacting devices are expediently of a pin-type configuration; in principle, it is, however, only important, as a result of the pivot axis of the protective bell fixed in transverse direction, for the upper end of the contact element to always be located opposite the respectively highest point of the contact surface of the protective bell during a pivoting of protective bell and lower contacting device relative to one another. Furthermore, the simplest way is to design the guide elements of the lower contacting devices as rail-like uprights, even if the guide elements can, in principle, be of a different configuration; like the state of the art, it may, however, be expedient to provide the guide elements at the top with an inclined insertion surface for the protective bells—such an inclined insertion surface is arranged on the side of the guide element facing the protective bell and extends (when seen in the direction of conveyance) at an angle from bottom to top and outwards (i.e. the upper end of the inclined insertion surface has a greater transverse distance from the protective bell than the lower end of the inclined insertion surface). To provide a good electrical contact as well as to avoid excessive wear and tear, it is, in addition, advantageous to design the upper end of the contact element in a ball shape.

To ensure a secure locking of the protective bell on the lower contacting device even after relatively small pivoting angles, and independently of the pivoting direction, a preferred embodiment of the inventive contacting device is designed such that the locking elements have approximately flat locking surfaces which face the axis of the axle stub and the planes of which extend approximately parallel to the axis of the axle stub and form with one another an angle having an angle bisector extending through the axis of the axle stub.

Tests by the applicant with the inventive contacting system have shown that it is recommendable to design this such that—when seen from above with a horizontally extending body carrier—the width of the opening formed by the locking elements of the protective bell is greater than the maximum width of the locking nose only to such an extent that during pivoting of the protective bell and, with it, the longitudinal central axis of the opening in relation to the longitudinal central axis of the guide slot through approximately 8°, preferably more than approximately 10°, the locking elements already prevent any passage of the locking nose through the opening.

So that the locking noses of the lower contacting devices can pass through the openings formed by the locking elements of the protective bells without further ado when a body carrier is placed on the conveyor hangers, it is recommended to provide corresponding, inclined slide-on surfaces on the locking elements and/or on the locking noses, where applicable also inclined slide-on surfaces for the purpose of enabling the lower edges of the protective bells to be lowered to easily pass the locking noses. For this purpose, the following features of preferred embodiments of the inventive contacting system are recommended: The locking nose has (when seen from the side) an end face sloping upwards and to the rear; furthermore, the locking nose can (when seen from above) have side surfaces extending at an incline upwards towards one another. It is, finally, favorable for the locking function when the locking nose (when seen from the front) has a flat lower side which extends transversely to the guide slot.

So that the system is not statically overdefined, preferred embodiments of the inventive contacting system are characterized by the fact that when the contact element is supported on the contact surface of the protective bell the axle stub does not abut either on the locking nose or on the end of the guide slot, which may easily be achieved by way of a corresponding dimensioning of the length of the guide slot and a corresponding arrangement of the locking nose on the guide element.

Additional features, advantages and details of the invention result from the attached claims and/or from the following description as well as the attached drawings of a particularly advantageous embodiment of the inventive contacting system, wherein this has been illustrated in the drawings and is described in the following only insofar as this is necessary for understanding the present invention with knowledge of DE-40 41 211-C1.

DETAILED DESCRIPTION OF THE INVENTION

Figure 1:
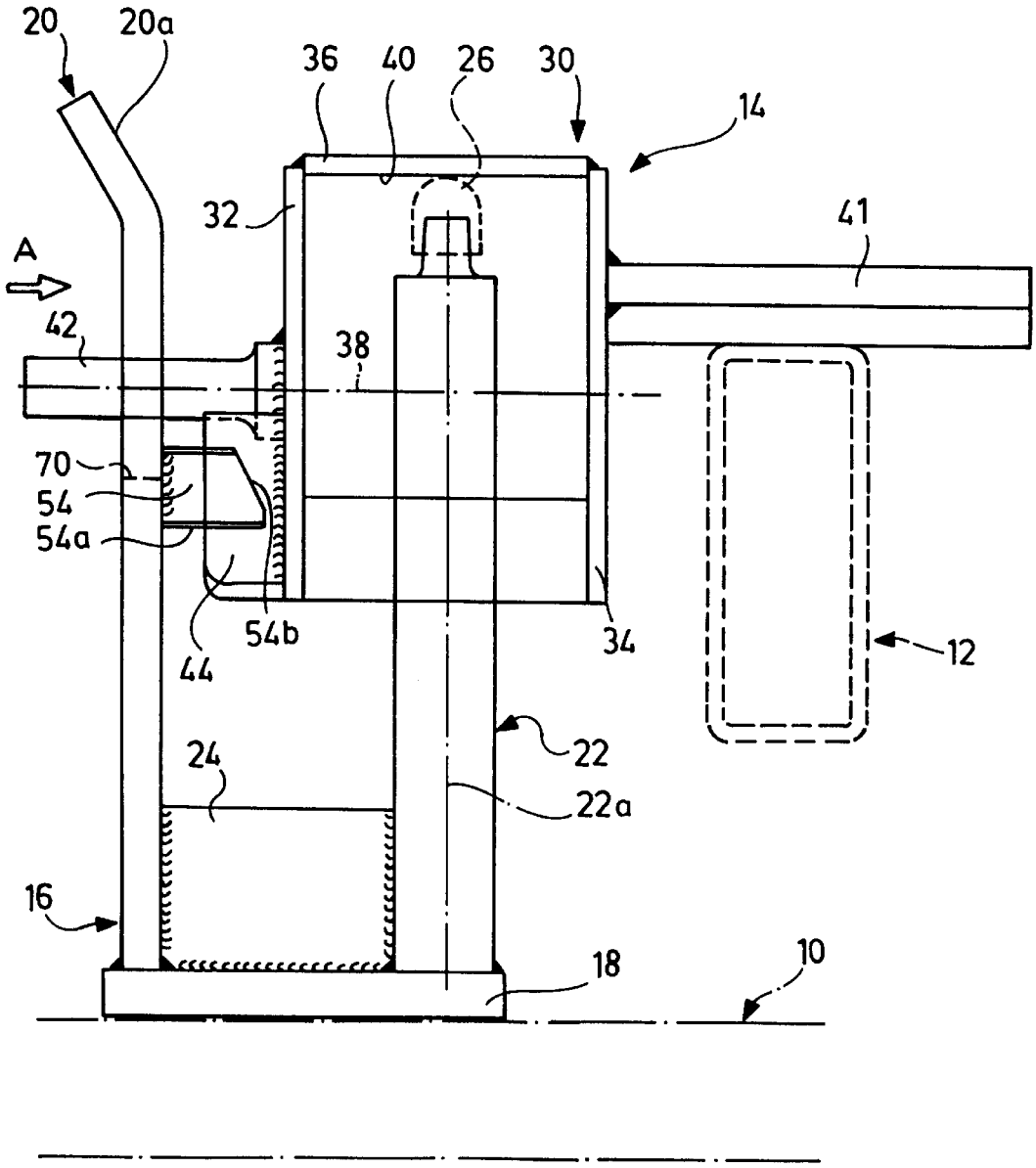
FIG. 1 shows the contacting system consisting of lower and upper contacting device, namely when seen in the direction of conveyance and in that state of the contacting system after a body carrier has been placed on the conveyor hangers and the conveyor hangers extend at right angles to the body carrier.

In FIG. 1, part of a lower crossbar 10 of a conveyor hanger of an overhead conveyor is indicated; this conveyor hanger is intended to have the shape of a rectangular frame consisting of a hollow, square steel section, wherein the plane of the frame normally extends vertically and at right angles to the direction of conveyance of the overhead conveyor and is intended to extend parallel to the plane of drawing in FIG. 1. Furthermore, a longitudinal frame leg 12 of a body carrier in the form of a rectangular body support frame is indicated in FIG. 1, namely in cross section; this support frame is welded together from portions of a hollow, square steel section, the plane of the frame extends in the normal case horizontally and at right angles to the plane of drawing of FIG. 1, and the longitudinal frame leg 12 is intended to be the right-hand longitudinal frame leg of the body support frame in accordance with FIG. 1.

Figure 2:
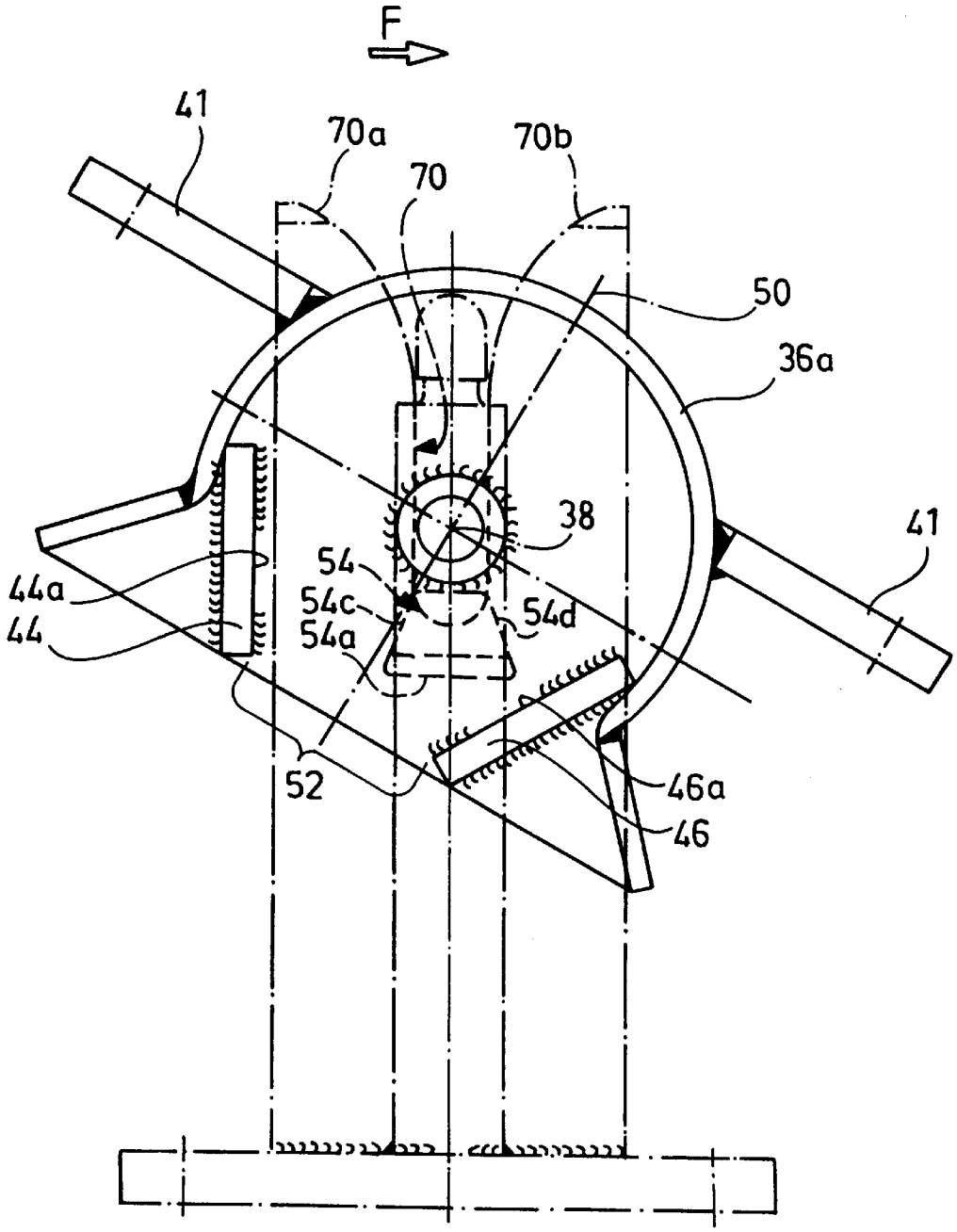
FIG. 2 shows a side view of the contacting system, seen in the direction of arrow A in FIG. 1, wherein the upper contacting device, i.e. the protective bell, is, however, illustrated pivoted through 30° and the lower contacting device has merely been indicated by a dash-dot line.
Figure 3:
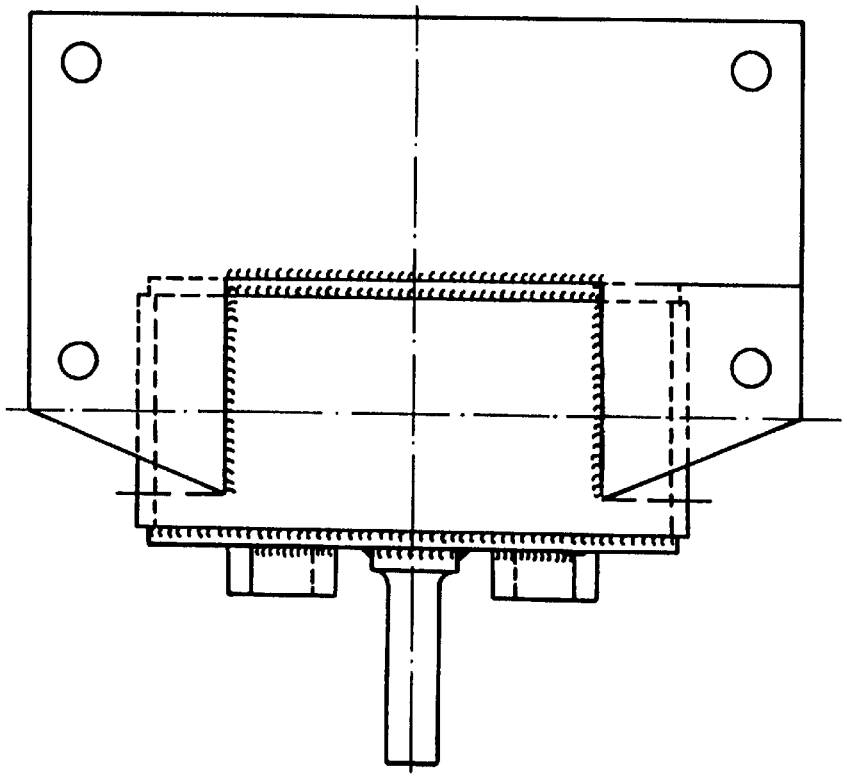
FIG. 3 shows a plan view of the upper contacting device, i.e. the protective bell.
Figure 4:
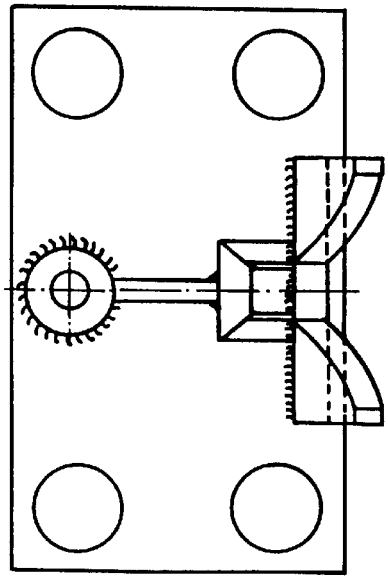
FIG. 4 shows a plan view of the lower contacting device.

The direction of conveyance of the overhead conveyor is intended to extend at right angles to the plane of drawing of FIG. 1 and is indicated in FIG. 2 by the arrow F; with respect to further details of the overhead conveyor, reference is made for the sake of simplicity to FIGS. 1 and 2 of DE-40 41 211-C1 and its description.

Figure 5:
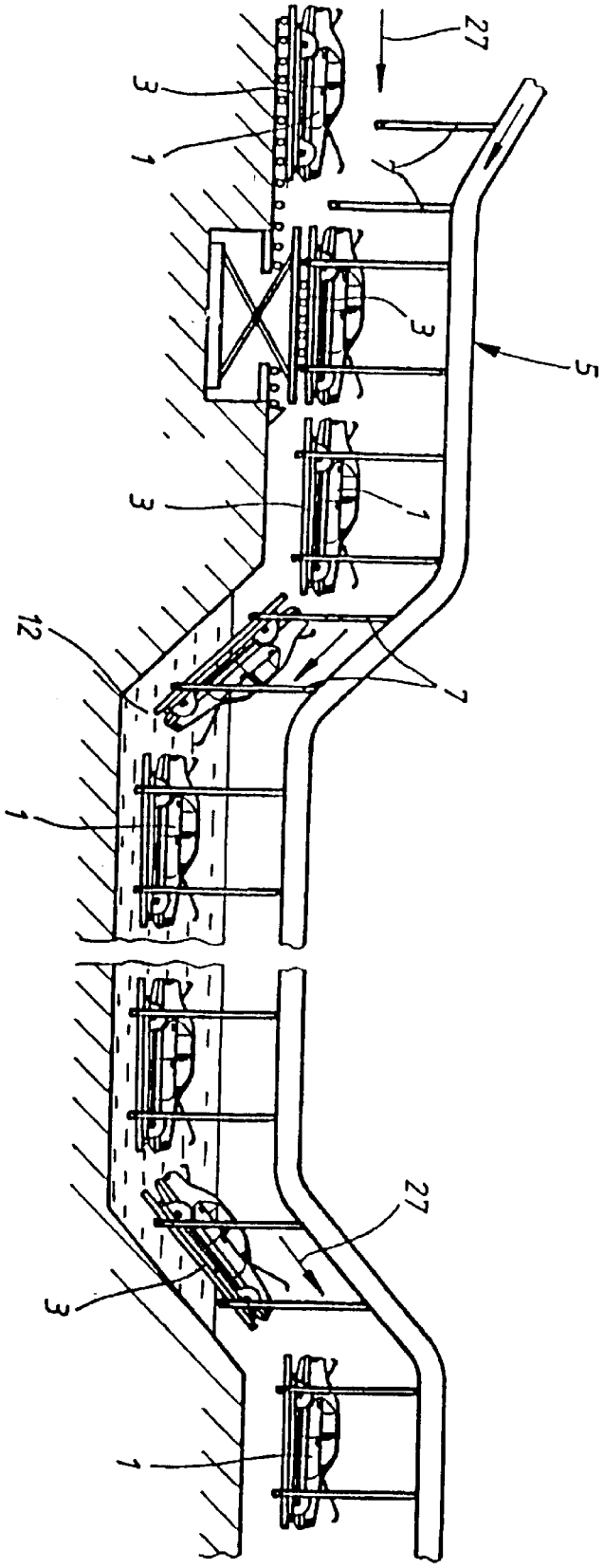
FIG. 5 shows an overview of an embodiment of an overhead conveyor system.

FIG. 5 shows an overview of the overhead conveyor system. The overhead conveyor 5 is shown traveling in the direction indicated by arrows 27. Conveyor hangers 7 engage beneath body carriers 3 for conveying motor vehicle bodies 1 through an aqueous suspension 12 wherein color particles are deposited on the bodies 1 by electrophoresis.

An upper contacting device designated as a whole as 14 is securely attached, e.g. by welding, to the longitudinal frame leg 12, and a lower contacting device designated as a whole as 16 is secured to the lower crossbar 10. The lower contacting device essentially consists of a base plate 18 secured to the crossbar 10, a rail-like guide upright 20 which projects vertically upwards and is welded to the base plate, a contact pin 22 welded to the base plate and projecting vertically upwards and a reinforcing web 24 which is connected by welding not only to the base plate 18 but also to the guide upright 20 and the contact pin 22. Base plate, guide upright, contact pin and reinforcing web consist of steel, a contact member 26 secured to the upper end of the contact pin 22 expediently of copper, wherein the contact member is of a spherical design at the top. A central longitudinal axis of the contact pin has been designated as 22*a;* this extends at right angles to the base plate 18 and through the center of the spherical upper side of the contact member 26.

The upper contacting device 14 has a protective bell 30 made of steel which is hollow inside and open at the bottom and has two side walls 32 and 34 as well as a circumferential wall 36; the latter has a circular cylindrical wall area 36*a* which extends over a circumferential angle of more than 180° and the cylinder axis of which has been designated as 38. The inner side of the wall area 36*a* forms a circular cylindrical support and contact surface 40 which is coaxial to the cylinder axis 38 and with which the protective bell 30 can be supported on the contact member 26 and thus on the contact pin 22. An attachment plate 41 made of steel is welded to the side wall 34 of the protective bell 30 facing away from the lower contact device 16 and this plate has, for its part, been secured to the longitudinal frame leg 12 by welding.

In accordance with the invention, an axle stub 42 is secured to the side wall 32 of the protective bell 30 facing the guide upright 20 and the axis of this axle stub coincides with the cylinder axis 38; furthermore, two locking bars 44 and 46 serving as locking elements and illustrated in FIG. 2 are secured to the side wall 32, only one of these bars, the locking bar 44, being illustrated in FIG. 1. At their sides facing the cylinder axis 38, the locking bars 44, 46 each form a flat locking surface 44*a* and 46*a,* respectively, which extends parallel to the cylinder axis 38; the two locking surfaces form with one another an acute angle, the angle bisector 50 of which extends through the cylinder axis 38, and between the lower ends of the locking bars 44, 46 there is an opening 52, through which a locking nose 54 welded to the guide upright 20 can pass in the direction of the angle bisector 50 when the angle bisector 50 extends at least approximately parallel to the longitudinal axis 22*a* of the contact pin 22 and thus at right angles to the base plate 18 of the lower contacting device 16.

The locking nose 54 has a flat lower side 54*a* extending parallel to the base plate 18, a sloped end face 54*b* and two inclined side surfaces 54*c* and 54*d*. The two side surfaces extending at an angle facilitate the passage of the locking nose 54 through the opening 52 when the protective bell 30 is lowered onto the contact pin 22 from above, and during this procedure the sloped end face 54*b* promotes the passing of the locking nose 54 through the lower edge of the side wall 32 of the protective bell 30.

The guide upright 20 is provided with a guide slot 70 which opens upwards and the side edges of which form in the upper area of the guide slot insertion curves 70*a* and 70*b* which ensure during the lowering of the upper contacting device 14 onto the lower contacting device 16 that the axle stub 42 enters the guide slot 70. Beneath the insertion curves 70*a,* 70*b,* the width or breadth of the guide slot 70 is only very slightly greater than the diameter of the axle stub 42.

The longitudinal central axis of the guide slot 70 extends, in accordance with the invention, parallel to the longitudinal axis 22*a* of the contact pin 22 in such a manner that when looking at the lower contacting device 16 in longitudinal direction of the lower crossbar 10 of the conveyor hanger the two axes are congruent.

In accordance with the invention, the various elements of the contacting system are arranged and dimensioned as follows:

When the angle bisector 50 extends parallel to the longitudinal axis 22*a* of the contact pin 22 and thus parallel to the longitudinal central axis of the guide slot 70, the locking nose 54 can pass in vertical direction through the opening 52 during the lowering of the upper contacting device 14 onto the lower contacting device 16.

When the circular cylindrical wall area 36*a* of the protective bell 30 touches the contact member 26 during the course of the lowering of the upper contacting device 14 and is supported on it, the axle stub 42 is still located above the lower end of the guide slot 70 and above the locking nose 54.

If the protective bell 30 is pivoted about the cylinder axis 38, one of the locking bars 44, 46 in cooperation with the locking nose 54 prevents the axle stub 42 lifting out of the guide slot 70 as soon as the pivot angle is greater than, for example, 10° because the locking nose 54 can then no longer pass through the opening 52.

If the axle stub 42 is located beneath the insertion curves 70*a,* 70*b* in the guide slot 70, the cylinder axis 38 intersects the longitudinal axis 22*a* of the contact pin 22 at least almost.

The locking nose 54 projects from the guide upright 20 to such an extent that it engages in the space between the two locking bars 44 and 46 once the upper contacting device 14 has been placed on the lower contacting device 16.

Finally, in accordance with the invention, the guide upright 20 has in the area of its upper end an inclined insertion surface 20*a* which extends at an angle from top to bottom in the direction towards the space between guide upright 20 and contact pin 22 and facilitates introduction of the side wall 32 of the protective bell 30 into this space during the lowering of the upper contacting device 14.

The present disclosure relates to the subject matter disclosed in German Application No. 198 39 725.9 of Sep. 1, 1998, the entire specification of which is incorporated herein by reference.

What is claimed is:

1. An electrical contacting system for an electrophoretic dip painting plant for motor vehicle bodies that are guided through an electrophoretic dip paint bath comprising an overhead conveyor having a plurality of conveyor hangers for engaging beneath body carriers, each carrier supporting one body and being placeable on two respective conveyor hangers, said hangers being arranged one behind the other in a direction of conveyance and being pivotable about upper pivot axes extending horizontally and transversely to the direction of conveyance, wherein each conveyor hanger has at least two lower contacting devices secured to said hanger and each body carrier has at least four upper contacting devices secured to said carrier and adapted to be placed on said lower contacting devices, each lower contacting device having a support and contact element pointing upwards as well as a guide element arranged next to said support and contact element transversely to the direction of conveyance and likewise pointing upwards, and each upper contacting device having a protective bell open at the bottom and storing a bubble of air in the submerged state, said protective bell having in the area of said bubble a downwardly concave, partially circular cylindrical support and contact surface adapted to be placed on a support and contact element and having a cylinder axis approximately horizontal and extending transversely to the direction of conveyance as well as on its outer side facing the guide element two locking elements forming a vertical opening between them for interacting with a locking nose on the guide element in order to make passage of the locking noses through the openings formed by the locking elements of the protective bells possible during placement of a body carrier on two conveyor hangers and to prevent any lifting of the protective bells away from the lower contacting devices during the inclined submergence of a body into the paint bath, said protective bell having at its outer side provided with the locking elements a rigid axle stub coaxial to the cylinder axis of its support and contact surface, and said guide element having for a lateral guidance of the axle stub an upwardly open guide slot parallel to the support and contact element of the lower contacting device, the side edges of said guide slot forming in the upper area of the guide slot insertion curves for the axle stub extending at an incline from top to bottom towards one another.

2. A system as defined in claim 1, wherein the support and contact element has a pin configuration.

3. A system as defined in claim 1, wherein the guide element comprises an upright rail.

4. A system as defined in claim 1, wherein the locking elements have approximately flat locking surfaces facing the axis of the axle stub, the planes of said surfaces extending approximately parallel to the axis of the axle stub and forming with one another an angle having an angle bisector extending through the axis of the axle stub.

5. A system as defined in claim 1, wherein the locking elements are arranged beneath the axle stub.

6. A system as defined in claim 1 wherein, when viewed from above, the width of the opening between the locking elements is greater than the maximum width of the locking nose only to such an extent that during pivoting of the protective bell and with it the longitudinal central axis of the opening in relation to the longitudinal central axis of the guide slot through at least an angle of 8° the locking elements prevent any passage of the locking nose through the opening.

7. A system as defined in claim 1, wherein beneath the insertion curves the width of the guide slot is only slightly greater than the diameter of the axle stub.

8. A system as defined in claim 1 wherein, when looking at the locking nose from the side, the locking nose has an end face sloping upwards and to the rear.

9. A system as defined in claim 1 wherein, when looking at the locking nose from the front, the locking nose has side surfaces extending at an incline upwards towards one another.

10. A system as defined in claim 1 wherein, when looking at the locking nose from the front, the locking nose has a flat lower side extending transversely to the guide slot.

11. A system as defined in claim 1, wherein the upper end of the contact element has a spherical design.

12. A system as defined in claim 1 wherein, when the contact element is supported on the contact surface of the protective bell, the axle stub abuts neither on the locking nose nor on the end of the guide slot.

* * * * *